United States Patent [19]

Mallory et al.

[11] 4,186,655

[45] Feb. 5, 1980

[54] METHOD AND APPARATUS FOR CONTROLLING FORCED AIR HEATING AND/OR COOLING

[76] Inventors: Lewis B. Mallory, 5370 Silver Hill Trail, Stone Mountain, Ga. 30083; Bob W. Dean, 760 Old Ivy Rd., Atlanta, Ga. 30342

[21] Appl. No.: 908,015

[22] Filed: May 22, 1978

[51] Int. Cl.[2] ..... F24F 11/04; F24F 3/00

[52] U.S. Cl. ..... 98/1; 236/49; 165/22; 415/17

[58] Field of Search ..... 98/1, 40 C, 40 R; 236/DIG. 9, 49, 11, 1ER; 165/15, 22; 415/17, 18

[56] References Cited

U.S. PATENT DOCUMENTS

| | | | |
|---|---|---|---|
| 3,841,394 | 10/1974 | Van Becelaere | 236/49 |
| 3,951,205 | 4/1976 | Zilbermann | 165/22 |
| 4,077,567 | 3/1978 | Ginn et al. | 236/49 |
| 4,099,553 | 7/1978 | Burnham et al. | 165/22 |
| 4,103,599 | 8/1978 | Walker | 236/49 |

*Primary Examiner*—Henry C. Yuen
*Attorney, Agent, or Firm*—Patrick F. Henry

[57] ABSTRACT

A forced air heating and/or cooling system in a building is provided with the usual main supply conduits or duct which have various branch ducts leading to different areas of the building. Pressure sensitive instruments at spaced locations in the main supply duct are connected by electrical wiring or pneumatic tubing to a comparing instrument which senses pressure signals from the different zones determining the maximum required pressure that must be supplied to the system. Zone thermostats sense increases in room temperature and operate conventional variable volume boxes to increase the supply of air thereby lowering the air pressure. The comparing instrument sends a signal to a variable speed drive comprising a motor having a spring loaded pulley connected by a drive belt to a fan pulley and the motor is electrically driven by a separate drive means to adjust the tension on the spring loaded pulley thereby changing the speed of the fan for a more economical operation.

3 Claims, 4 Drawing Figures

14
26'
28
30
28
14
30
34
$I_P$
34
$I_P$
30
28
26
14
14
12
T
32
24
10
20
22
68
18
$I_D$
36
56
42
49
66
16

METHOD AND APPARATUS FOR CONTROLLING FORCED AIR HEATING AND/OR COOLING

BACKGROUND OF THE INVENTION

1. Field of the Invention

Forced air duct systems, especially for purposes of heating and air conditioning, employing fan control methods and apparatus. Means for controlling temperature in response to changes in pressure.

2. Description of the Prior Art

Conventional forced air heating or cooling systems, or combined heating and cooling systems, employ one or more air ducts leading to various areas such as rooms or zones in a building. There is usually a main or primary air duct leading from the furnace of air cooling means and the main or primary duct branches out into various areas. Dampers may be employed to balance the system. Temperature sensing thermostats are located in various areas but of course delivery of warmer or cooler air to one area affects the other areas and upsets the balance of the system. Due to the high cost of energy and the anticipated higher cost considerable attention is being given to more efficient operation of forced air heating and cooling systems in an effort to find reasonably comfortably conditions which are as efficient as possible. It has been determined previously that effective fan control is one means of dealing with the problem. For example, in U.S. Pat. No. 3,814,173 the various control functions are provided in response to electrical signals which are digital in nature and the air fan associated with the furnace or cooling coils has its speed changed by digital increments in response to the total demand for heated or cooled air by means of an SCR controller for the fan motor and the SCR controller has a speed setting potentiometer with a plurality of taps enabling different segments of its total resistance to be shorted out, so as to increase accordingly input voltage to the fan motor. This system involves the coordination of multiple thermostats and the resolution thereof for averaging SCR fan speed control. Due to the expense involved and the cost of installing and maintaining SCR fan speed control equipment and the coordination of multiple thermostats there are certain disadvantages in comparison with the present system which does not rely solely upon thermostat or temperature reading but rather employs a means for sensing the internal duct pressure and the use of a standard comparing instrument to increase duct pressure by changing fan speed. In addition, fan speed is varied mechanically through the use of the spring loaded pulley which can be purchased on the open market in conjunction with a drive mechanism for changing the tension on the drive belt between the pulley and the motor. The present system does not require expensive solidstate electronics and can be applied to modify any new or existing forced air system.

SUMMARY OF THE INVENTION

In a forced air heating and/or cooling system employing a duct system in which air is moved by means of an air moving means such as a motor blower or fan, pressure sensing devices transmit signals to a conventional comparing instrument which accepts the various signals to determine the lowest pressure signal thereby sending an activating signal to increase or decrease the fan speed.

In a preferred embodiment, the fan speed is varied primarily mechanically through the use of a drive belt driving a driven pulley on the fan and driven by a spring loaded variable pulley on the electric motor together with a means for increasing or decreasing the distance between the drive pulley and the driven pulley so as to change the tension on the spring loaded drive pulley thereby varying the speed of the fan.

Also, in a preferred embodiment of the invention, in addition to the usual thermostat readings for the different spaces or locations there are conventional pressure sensing instruments which sense the internal duct pressure which results from the room thermostat sensing an increase in room temperature and operating a variable volume box to increase the supply of air to the space where the termostat is located.

Other and further objects and advantages of this invention will become apparent upon reading the following description of a preferred embodiment taken in conjunction with the accompanying drawings.

BRIEF DESCRIPTION OF A PREFERRED EMBODIMENT

Figure 1:
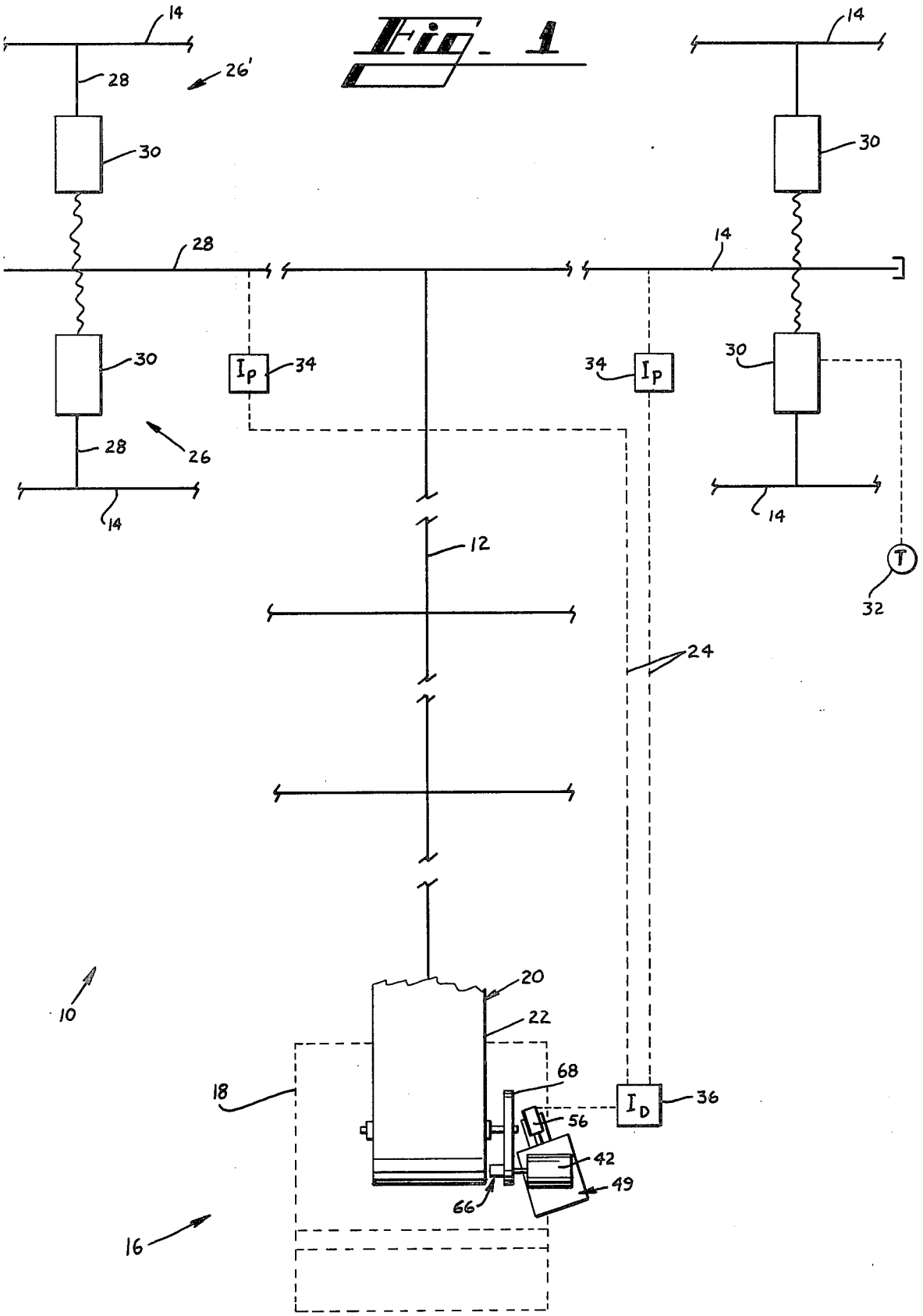
FIG. 1 is a diagram of a typical building duct system incorporating the present air duct system pressure control.
Figure 2:
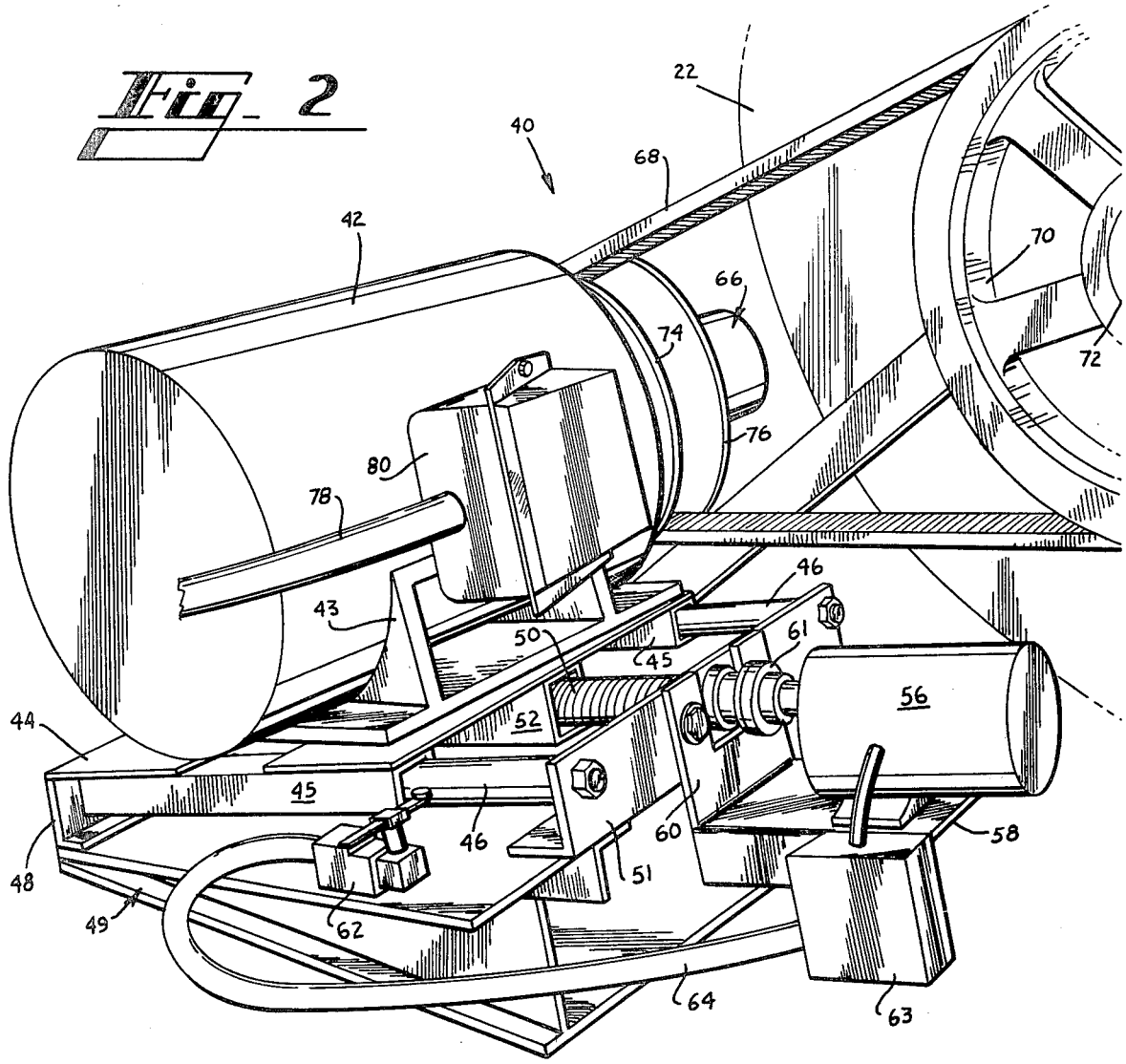
FIG. 2 is a perspective view of the fan control arrangement.

A typical building duct system is designated generally by reference numeral 10 and comprises conventional heating or air conditioning ducts 12 having branches 14 leading to various areas of the building, which could be individual rooms or just areas of a large open space.

The heating and air conditioning equipment is designated generally by reference numeral 16 and is of any conventional design including a casing or housing 18 in which is located the heating and/or air conditioning(A-C) fan assembly 20 comprising an AC fan 22 driven by variable speed drive to be described hereinafter.

In the drawing, the solid or heavy lines represent the building duct system 12, 14 and the dashed or broken lines represent the wiring or presents control lines 24 between the various control components. Building zones are represented by intersections and reference numeral 26 and the duct 28 connecting the zones to the main supply duct 12 may incorporate closed variable volume boxes 30 which operate as volume control boxes to throttle supply air to the zones in response to a zone thermostat 32.

At spaced locations in the main supply duct 12 there are instruments 34 generally known as static pressure controllers or static pressure sensors which sense the internal duct pressure. Instruments 34, as well as other components such as thermostats in this system, can be purchased on the open market from, for example: Johnson Control Company of 507 East Michigan Street, Milwaukee, Wisconsins; Honeywell, Inc. of Minneapolis, Minnesota.

The pressure sensing instruments 34 are connected by wiring (or pneumatically) to a comparing instrument 36 which is capable of sensing pressure signals from the various zones 26 according to the information from each of the pressure sensing instruments 34 and determines the maximum required pressure that must be supplied to the system. The comparing instrument 36 is a conventional item purchasable on the open market, as follows:

| Manufacturer | Item |
|---|---|
| Johnson Control Company<br>507 East Michigan Street<br>Milwaukee, Wisconsin 53201 | Maximum Signal Accumulator<br>or<br>High Signal Discriminator |

The instruments 34 which sense the internal duct pressure are located near the extremities of the duct system 12.

Fan 22 is provided with a varible speed drive mentioned previously and to be described hereinafter. The variable speed drive for fan 22 acts in response to the signal from the comparing instrument 36 to increase or decrease the speed of the fan 22.

OPERATION

The various zone thermostats 32 sense any increase in room temperature and operate the variable volume box 30 to increase the supply of air to the space wherein the thermostat is located. The increase flow in the supply duct 12 lowers the air pressure in the supply duct 12 due to the resistance in the duct systems to increased air flow. The pressure sensing instrument 34 (Ip) sensing the lower internal duct pressure responds to the lower pressure caused by the increased flow to send a signal to the comparing instrument 36 to increase the duct pressure. Likewise, the other instruments 34 sensing the internal duct pressure and being located near the extremities of the duct system respond in the same manner.

The comparing instrument 36 (Id) receives and accepts the signals from the various duct pressure sensing instruments 34, the signals are compared by the instrument 36 and the lower pressure signal (or higher pressure as the case may be) acts through the instrument 36 to send an activating electrical signal to the positioning drive of the fan 22 to increase the fan speed (or decrease as the case may be) and thus increase the air flow (or decrease same) and system pressure in duct 12.

VARIABLE DRIVE FAN

The variable drive or fan 22 is designated generally by reference numeral 40. The drive motor 42 is mounted in a cradle 43 on a slidable motor base 44 constructed from heavy metal and having channels 45 slidably receiving a pair of longitudinal guide frame members 46 connected by an end plate member 48. The motor base plate 44 is mounted for movement on a fixed or stationary base 49. The members 46 act as longitudinal rails. A drive screw 50 having one end journaled in an end piece plate 51 extends beneath the plate 44 into an internally threaded tubular socket screw drive member 52 which is mounted beneath plate 44.

An electrical drive motor 56 is mounted on fixed base 49 by an L-shaped bracket 58 which has an upwardly extending plate 60 bolted to the plate 51. Motor 56 is coupled by coupling 61 to the drive member 50 and is operated electrically by means of an electrical signal from the comparing instrument through a cable 62 leading to a box 63. Micro limit switches 64 are connected by cable to box 63 and are wired into the motor 56 to limit moving in one direction or the other.

A special, adjustable spring pulley 66 is mounted on shaft of motor 42 and is connected by drive belt 68 to a pulley 70 mounted on shaft 72 of the fan 22. The special drive pulley 66 is a commercially available item having a fixed side 74 and a movable side 76 which is spring biased so that the drive pulley 66 will open or close in response to the amount of pressure or pull from the drive belt 68 thereby changing the effective belt contact diameter which in turn increases or decreases the driven speed of the fan 22. Motor 42 is electrically connected by cable 78 to motor box 80. Spring pulleys like pulley 56 are purchasable on the open market as follows:

| Manufacturer | Item |
|---|---|
| Speed Selector, Inc.<br>516 East Washington Street<br>Chagrin Falls, Ohio 44022 | Variable speed, spring loaded pulley |
| Reliance Electric Co.<br>24701 Euclid Avenue<br>Cleveland, Ohio 44117 | Reeves Vari-speed Pulley |

As mentioned previously, the instrument 36 sends the proper signal to the fan motor positioning drive to obtain the required pressure. The operation of the drive motor 56 in one direction or the other through the coupling 60 operates the drive 50 to move the motor 42 towards or away from the fan shaft 72 thereby changing the center-to-center distance of the drive shaft of the motor 42 and the pulley 72 of fan 22 and the resulting tension on the belt 68 causes the spring restrained side 76 of the driving sheave or pulley 66 to open or close thus changing the effective belt 68 contact diameter which in turn increases or decreases the driven speed of the fan 22. The motor 42 moves at an angle on the angled frame 46. The angle of the movement of the positioning drive acts to compensate for the movement of the spring restrained side 70 of the drive pulley 66 thus keeping the belt 68 on the centerline of the sheave.

Figure 4:
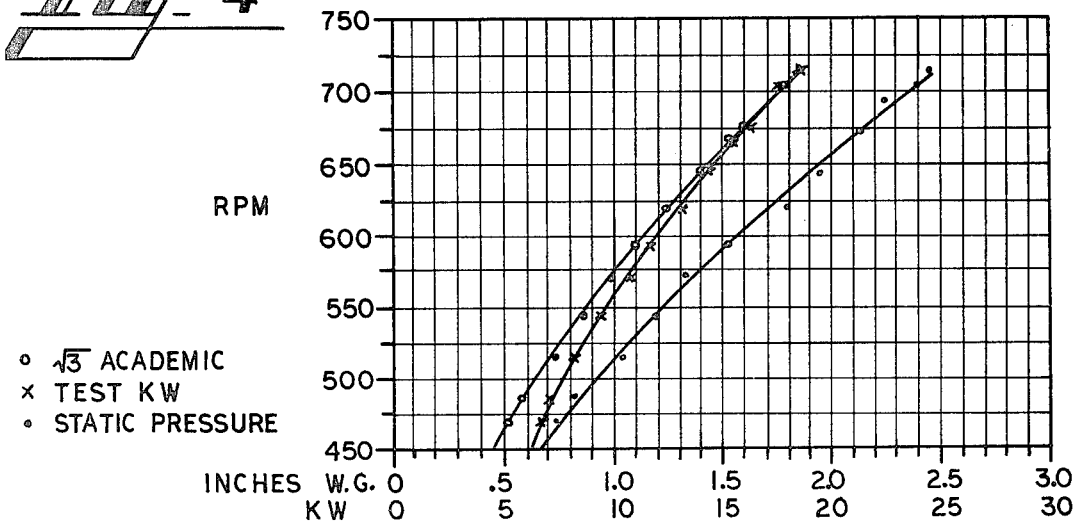
FIG. 4 is a graph showing fan RPM plotted against static pressure and KW for a typical curved blade fan with variable speed.
Figure 3:
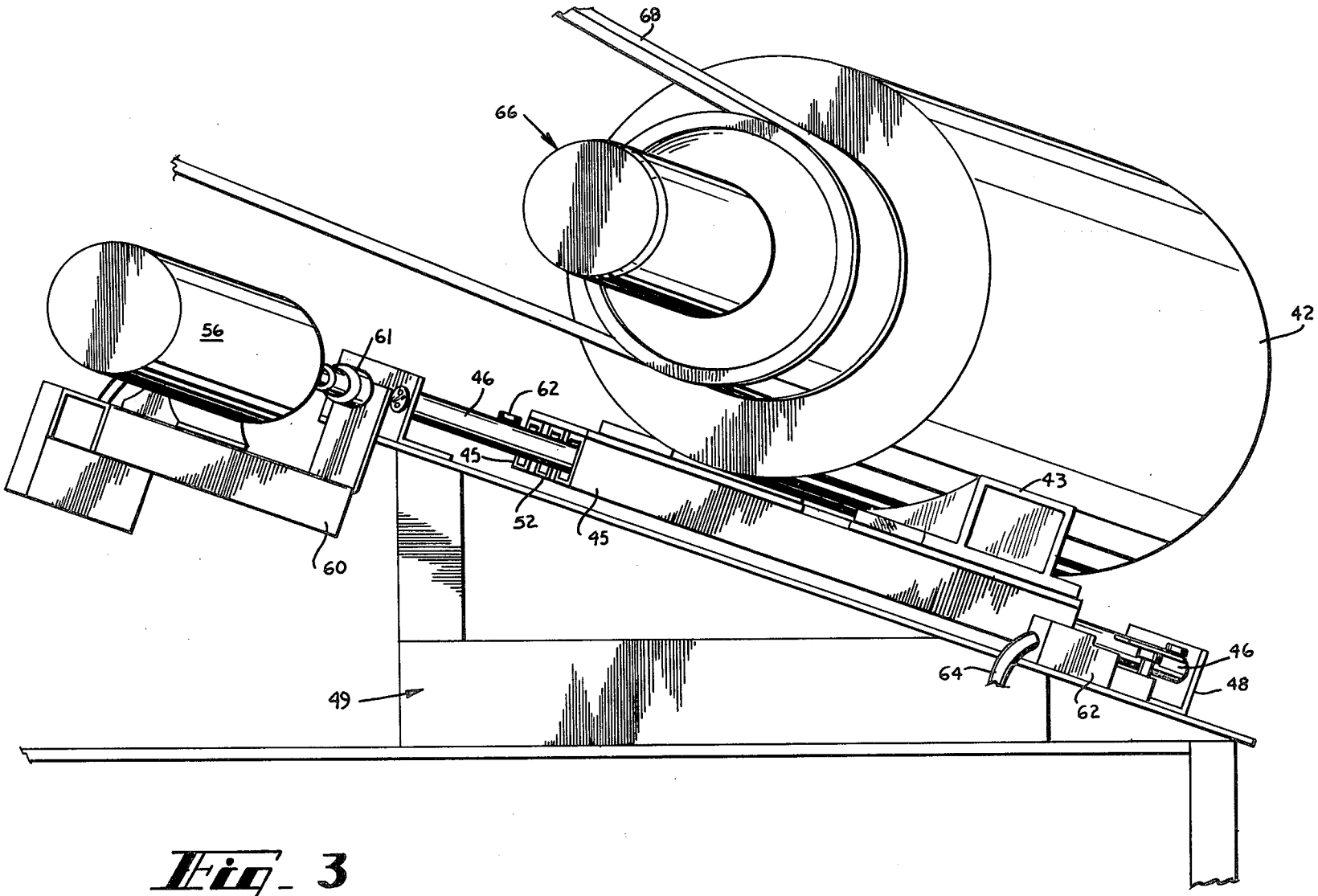
FIG. 3 is a side elevation view of the fan control mechanism.

The HP required to drive a fan varies as the cube of the speed. Thus, varying the speed is the most power efficient method of affecting fan control and by determining the least pessure required near the point of usage in the duct system and varying the speed of the fan to obtain this required pressure less energy is used than in any other known method. This system accomplishes this economical first cost. FIG. 4 illustrates in graph form the relationship between fan RPM on one side and the academic or theoretical cube of the speed ($\sqrt{3}$) or as well as the KW used on the static pressure. The drive's efficiency is sustained over the entire range. Thus, this system accomplishes a maximum of power savings over the entire range of speed control.

By way of Summation:

(a) The individual room thermostats 32 individually sense any increase in the room temperature and the respective spaces and act through the respective variable volume boxes 30 to increase or decrease the supply of air to the space wherein the thermostat is located.

(b) The increased flow in the ducts 12 and respective branches 14 lowers or raises the air pressure in the duct 14 due to the resistance or reduced resistance in the duct system 12 to the increased or decreased air flow.

(c) The pressure sensitive instrument 34 sensing the internal duct pressure change responds to the lower or higher pressure caused in the duct 14 and sends a signal to the comparing instrument 36 to increase or decrease the duct pressure.

(d) Other instruments 34 located near the extremities of the duct system 12 also sense the duct pressure and supply signals to the comparing instrument 34 which accepts the signals from the various duct pressure sensing instruments 34 and compares the signals and determines an index, which may be lowest pressure, and acts through the comparing instrument 34 to signal the positioning drive 40 to increase or decrease the fan speed and thus increase or decrease the air flow and system pressure.

(e) The positioning drive 40 acts to increase the fan speed by moving the drive motor 42 towards or away from the pulley 70 causing the spring restrained side of the drive sheave or pulley 66 to open or close toward the fixed side of the drive sheave 70 to maintain in the belt tension and as the drive sheaves open the effective diameter of the sheave is decreased and conversely as the drive sheave closes the effective diameter of the sheave is increased and the drive motor at constant (RPM) speed will act to drive the fan sheave at greater speed (RPM) in ration to the diameter of the drive sheave.

(f) The fan sheave is driven faster (more RPM) and the fan rotating speed is increased in ratio to the diameter of the drive sheave.

(g) Thus, the basic fan laws function:

(1) fan air volume in cubic ft. per minute of air varies directly with the fan speed (RPM).

(2) the fan discharge pressure varies with the square of the fan speed (RPM).

(3) the power to drive the fan varies with the cube of the fan speed (RPM).

It is the variation of the input power to drive the fan that varies with the cube of the speed that makes this means of control so desirable. Thus, by reducing the fan speed by one-third the power to drive the fan is reduced to one-ninth.

The graph of FIG. 4 discloses the relationship between RPM of the fan speed and the volume produced.

The variable air box 30 or (VAV) for variable air volume is a conventional heating and air conditioning component which is purchasable on the open market. Barber-Coleman Company of Rockford, Illinois, sells both an electric and a pneumatic control box which employs a butterfly or other type of damper responsive to signals from a thermostat or the like to alter the damper to change the air flow either to increase or decrease same. Carnes Corporation of Verona, Wisconsin, also manufactures and sells a VAV.

Although it has been referred herein to the room thermostats 32 sensing an increase in room temperature and acting to increase the supply of air the opposite applies too, in that the room thermostat 32 also senses a decrease in room temperature and acts through the variable volume box 30 to decrease the supply of air.

While I have shown and described a particular embodiment of this invention together with suggested mode of operation thereof this is by way of illustration only as serious alterations, substitutions, changes, deviations, eliminations, additions and departures may be made in the method and apparatus shown without departing from the scope of the invention as defined only by a proper interpretation of the appended claims.

What is claimed is:

1. In a control system for heating and/or air conditioning system in a building having areas and wherein there is an air passage means such as a duct or conduit leading from a furnace of air cooling means in which there is located an air moving means such as a blower or fan for moving air, one or more individual means such as variable volume boxes located in communication with said air passage means to increase or decrease the supply of air therein, and a plurality of temperature sensing devices in different locations in a building to sense the increase or decrease of temperature therein for controlling the air moving means, the improvement comprising:

(a) a plurality of pressure sensing means located in different locations within said duuct system to sense a change of pressure therein and to generate a signal to actuate, (b) an air moving control means which accepts the signals from the various duct pressure sensing means and compares said signals to determine the signal to send to the air moving means, and (c) means for varying the speed of the air moving means in response to the signal received from said comparing instrument, (d) said means for varying the speed of the air moving means comprising a pulley drive such as a belt member, a variable pulley responsive to changes in tension on said pulley drive member, and electrical drive means for changing pulley tension.

2. The system in claim 1 wherein said air moving means and said pulley are relatively movable by said electrical drive means, and said electrical drive means comprises an electrical motor responsive to said signal from said air moving control means, and drive means driven by said motor for selectively moving said variable pulley closer to or away from said air moving means thereby to vary the tension on said pulley drive member to change the speed of said air moving means to increase or decrease the air.

3. The device of claim 2 wherein said variable pulley includes a movable plate and a fixed plate, said movable plate being moved by increase in tension thereon to separate said movable plate and said fixed plate to vary the contact.

* * * * *